US011015447B2

(12) United States Patent
Zainalabedin et al.

(10) Patent No.: US 11,015,447 B2
(45) Date of Patent: May 25, 2021

(54) SAMPLING SUBTERRANEAN FORMATION FLUIDS IN A WELLBORE

(71) Applicant: Saudi Arabian Oil Company, Dhahran (SA)

(72) Inventors: Khalid A. Zainalabedin, Dhahran (SA); Mark A. Proett, Missouri City, TX (US); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/414,533

(22) Filed: May 16, 2019

(65) Prior Publication Data

US 2020/0362699 A1 Nov. 19, 2020

(51) Int. Cl.
*E21B 49/10* (2006.01)
*E21B 49/08* (2006.01)

(52) U.S. Cl.
CPC ..... *E21B 49/10* (2013.01); *E21B 49/081* (2013.01)

(58) Field of Classification Search
CPC ..... E21B 49/10; E21B 49/081
See application file for complete search history.

(56) References Cited

U.S. PATENT DOCUMENTS 7,703,317 B2 4/2010 Goodwin et al.
8,109,140 B2 2/2012 Tustin et al.
8,496,054 B2 7/2013 Zazovsky et al.
2008/0066536 A1* 3/2008 Goodwin ..... E21B 49/10 73/152.24
2009/0008079 A1* 1/2009 Zazovsky ..... E21B 36/04 166/60
2009/0159278 A1 6/2009 Corre et al.
2011/0272150 A1 11/2011 Ives et al.
2013/0175036 A1 7/2013 Hausot

OTHER PUBLICATIONS

Abernethy, "Production increase of heavy oils by electromagnetic heating," Journal of Canadian Petroleum Technology, Jul.-Sep. 1976, 8 pages.
Almansour and Al-Bassaz, "Physical and Chemical characterization and evaluation of organic matter from tar-mat samples: Case Study of Kuwaiti Carbonate Reservoir," Journal of Chemical Technology App vol. 1, Issue 1, Sep. 2017, 12 pages.
Alomair et al., "Viscosity Prediction of Kuwaiti Heavy Crudes at Elevated Temperatures," Paper SPE 150503, presented at the SPE Heavy Oil Conference and Exhibition, Kuwait, Dec. 12-14, 2011, 18 pages.

(Continued)

*Primary Examiner* — David J Bagnell
*Assistant Examiner* — Yanick A Akaragwe
(74) *Attorney, Agent, or Firm* — Fish & Richardson P.C.

(57) ABSTRACT

A formation fluid sampling tool includes a housing, and at least one sampling probe proximate an external surface of the housing. The at least one sampling probe includes an opening sized and positioned to receive one or more heated formation fluids, and a plurality of heating elements arranged concentrically around the opening and configured to conductively heat a subterranean formation through an external surface of the sampling probe.

19 Claims, 7 Drawing Sheets

(56) References Cited

OTHER PUBLICATIONS

Bermudez et al., "Assisted Extra Heavy Oil Sampling by Electromagnetic Heating," Society of Petroleum Engineers, presented at the SPE Heavy and Extra Heavy Oil Conference—Latin American, Colombia, Sep. 24-26, 2014, 13 pages.
Wilhelms and Larter, "Origin of tar mats in petroleum reservoirs Part II: Formation mechanisms for tar mats," Marine Petroleum Geology vol. 11, Issue 4, Aug. 1994, 15 pages.
PCT International Search Report and Written Opinion issued in International Application No. PCT/US2020/032828 dated Jul. 31, 2020, 15 pages.

* cited by examiner

SAMPLING SUBTERRANEAN FORMATION FLUIDS IN A WELLBORE

TECHNICAL FIELD

This disclosure relates to apparatus, systems, and methods for sampling subterranean formation fluids, and, more particularly, sampling subterranean formation fluids containing heavy oils.

BACKGROUND

Formation fluid sampling is often conducted in oil and gas exploration and development operations to assess the composition of formation fluids contained in a subterranean formation prior to further development of the natural resources in the formation. Typically, formation fluid sampling is performed using downhole formation fluid sampling tools that include a central opening configured to collect formation fluid from a subterranean formation adjacent a wellbore. However, certain types of formation fluids, such as heavy oil, have a high viscosity, and, as a result, low mobility. The low mobility of heavy oil makes sampling heavy oil using a conventional sampling tool challenging.

SUMMARY

In an example implementation, a formation fluid sampling tool includes a housing, and at least one sampling probe proximate an external surface of the housing. The at least one sampling probe includes an opening sized and positioned to receive one or more heated formation fluids, and a plurality of heating elements arranged concentrically around the opening and configured to conductively heat a subterranean formation through an external surface of the sampling probe.

In an aspect combinable with the example implementation, the external surface of the sampling probe is configured to contact a wellbore proximate the subterranean formation.

In another aspect combinable with any of the previous aspects, the plurality of heating elements is disposed on the external surface of the at least one sampling probe.

In another aspect combinable with any of the previous aspects, the at least one sampling probe further includes at least one sealing element disposed on the external surface of the at least one sampling probe.

In another aspect combinable with any of the previous aspects, the at least one sealing element is disposed between two heating elements of the plurality of heating elements.

In another aspect combinable with any of the previous aspects, the at least one sampling probe further includes a conductive layer disposed between the plurality of heating elements and the external surface of the at least one sampling probe, the conductive layer configured to transfer heat from the plurality of heating elements to the external surface of the at least one sampling probe.

In another aspect combinable with any of the previous aspects, the plurality of heating elements is arranged as concentric circles or concentric ovals around the opening.

In another aspect combinable with any of the previous aspects, the distance between adjacent heating elements of the plurality of heating elements is equal.

In another aspect combinable with any of the previous aspects, each of the plurality of heating elements is configured to be heated to a different temperature.

In another aspect combinable with any of the previous aspects, the at least one sampling probe includes two or more sampling probes arranged radially on the external surface of the housing.

Another aspect combinable with any of the previous aspects further includes at least one pressure sensor configured to measure a pressure of a subterranean formation.

In another example implementation, a downhole tool includes a downhole conveyance, a housing configured to couple with the downhole conveyance, and at least one sampling tool disposed proximate an external surface of the housing. The at least one sampling tool includes an opening configured to receive one or more heated formation fluids, and a plurality of heating elements arranged concentrically around the opening and configured to conductively heat a subterranean formation through the external surface of the at least one sampling tool.

In an aspect combinable with the example implementation, the external surface of the at least one sampling tool is configured to contact a subterranean formation.

In another aspect combinable with any of the previous aspects, the plurality of heating elements is disposed on the external surface of the sampling tool.

In another aspect combinable with any of the previous aspects, the downhole conveyance includes at least one of a wireline, an e-line, or a working string.

Another aspect combinable with any of the previous aspects further includes at least one pressure sensor configured to measure a pressure of a wellbore and a pressure of the subterranean formation.

In another aspect combinable with any of the previous aspects, the sampling tool further includes at least one sealing element disposed on an external surface of the sampling tool.

In another example implementation, a formation fluid sampling method includes positioning a formation fluid sampling tool in a wellbore and in conductive heat transfer contact with a subterranean formation, heating an external surface of an at least one sampling probe of the formation fluid sampling tool using a plurality of heating elements arranged concentrically around an opening of the at least one sampling probe, conductively transferring heat from the heated external surface of the at least one sampling probe to one or more formation fluids entrained in the subterranean formation, and receiving, through the opening of the at least one sampling probe, the heated one or more formation fluids.

An aspect combinable with the example implementation further includes circulating the heated one or more formation fluids through at least one of a pressure sensor, a sample chamber, or a fluid identification system.

In an aspect combinable with any of the previous aspects, positioning the formation fluid sampling tool in the wellbore and in conductive heat transfer contact with the subterranean formation includes physically contacting the external surface of the at least one sampling probe to an inner wall of the wellbore.

In an aspect combinable with any of the previous aspects, positioning the formation fluid sampling tool in the wellbore and in conductive heat transfer contact with the subterranean formation includes extending the at least one sampling probe outward from a housing of the sampling tool towards the subterranean formation An aspect combinable with any of the previous aspects further includes monitoring one or more conditions of the wellbore with at least one sensor of the formation fluid sampling tool.

Example embodiments of the present disclosure may include one, some, or all of the following features. For example, a formation fluid sampling tool according to the present disclosure may reduce the viscosity of one or more formation fluids, increase the mobility of one or more formation fluids, and increase the flow rate of one or more formation fluids. A formation fluid sampling tool according to the present disclosure may reduce the power required to heat one or more formation fluids compared to conventional formation fluid heating techniques. A formation fluid sampling tool according to the present disclosure may allow for sustained heating while sampling the formation fluids, and can be cooled if necessary by mud circulation.

The details of one or more embodiments are set forth in the accompanying drawings and the description. Other features, objects, and advantages will be apparent from the description and drawings, and from the claims.

DETAILED DESCRIPTION

The present disclosure describes a sampling tool and system for sampling fluids from a subterranean formation. In some aspects, the sampling tool and system provide for sampling of heavy oil contained within a subterranean formation.

Figure 1:
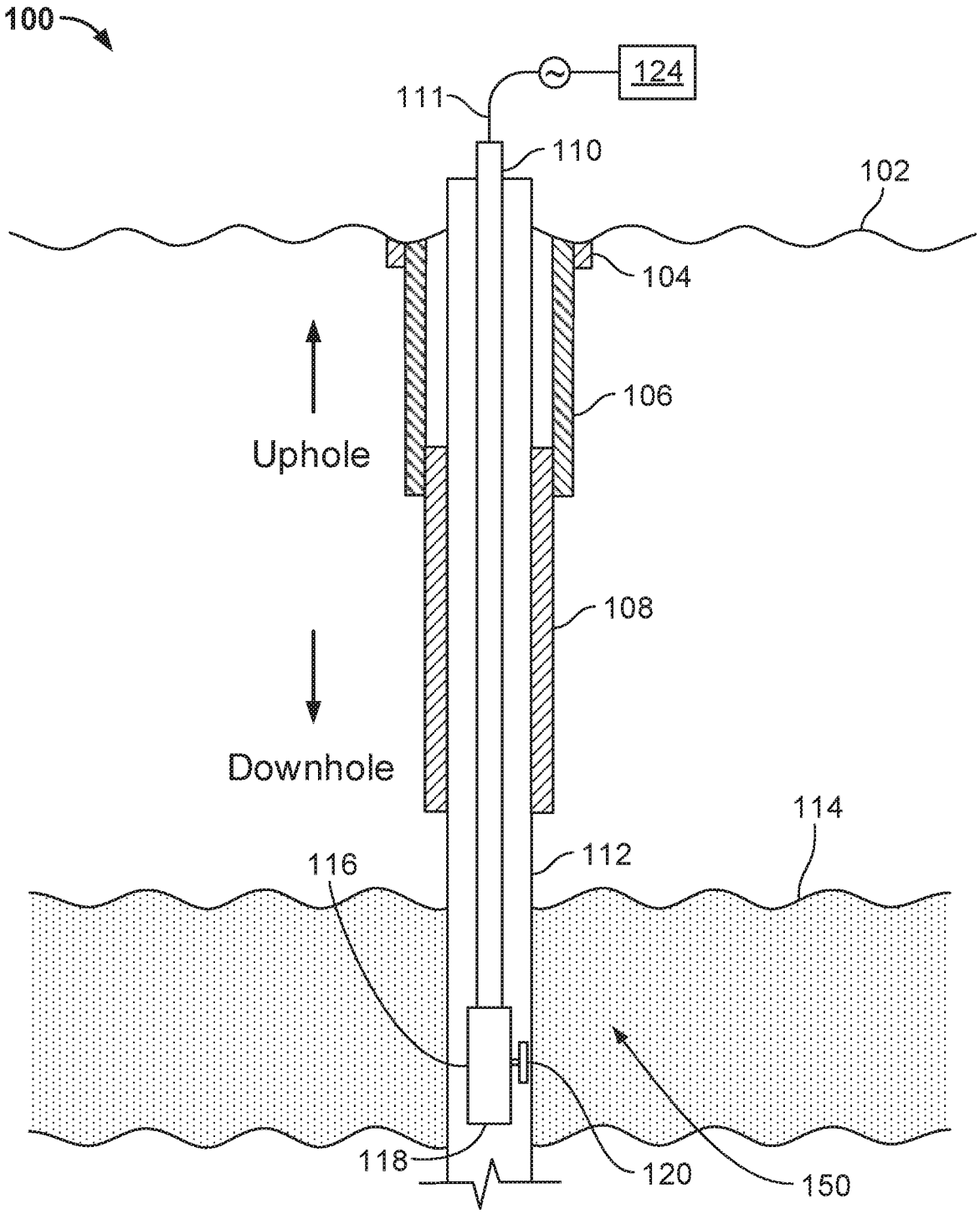
FIG. 1 is a schematic illustration of wellbore system that includes an example implementation of a formation fluid sampling tool according to the present disclosure.

FIG. 1 is a schematic illustration of an example wellbore system 100 including a formation fluid sampling tool 116. As illustrated in FIG. 1, an implementation of the wellbore system 100 includes a downhole conveyance 110 that is operable to convey (for example, run in, or pull out, or both) the formation fluid sampling tool 116 through a wellbore 112.

Although not shown, a drilling assembly deployed on the terranean surface 102 may form the wellbore 112 prior running the formation fluid sampling tool 116 into the wellbore 112 to a particular location in the subterranean zone 114. The wellbore 112 may be formed to extend from the terranean surface 102 through one or more geological formations in the Earth. One or more subterranean formations, such as subterranean zone 114, are located under the terranean surface 102. One or more wellbore casings, such as surface casing 106 and intermediate casing 108, may be installed in at least a portion of the wellbore 112.

Although shown as a wellbore 112 that extends from land, the wellbore 112 may be formed under a body of water rather than the terranean surface 102. For instance, in some embodiments, the terranean surface 102 may be a surface under an ocean, gulf, sea, or any other body of water under which hydrocarbon-bearing, or water-bearing, formations may be found. In short, reference to the terranean surface 102 includes both land and underwater surfaces and contemplates forming or developing (or both) one or more wellbores 112 from either or both locations.

Generally, the wellbore 112 may be formed by any appropriate assembly or drilling rig used to form wellbores or boreholes in the Earth. A drilling assembly may use traditional techniques to form such wellbores or may use nontraditional or novel techniques. In some embodiments, a drilling assembly may use rotary drilling equipment to form the wellbore 112. Although shown as a substantially vertical wellbore (for example, accounting for drilling imperfections), the wellbore 112, in alternative aspects, may be directional, horizontal, curved, multi-lateral, or other forms other than merely vertical.

In some aspects, the downhole conveyance 110 may be a tubular work string made up of multiple tubing joints. For example, a tubular work string typically consists of sections of steel pipe, which are threaded so that they can interlock together. In alternative embodiments, the downhole conveyance 110 may be a wireline. In some examples, the downhole conveyance 110 may be an e-line.

Once the wellbore 112 is formed (or in some cases during portions of forming the wellbore 112), one or more tubular casings may be installed in the wellbore 112. As illustrated, the wellbore 112 includes a conductor casing 104, which extends from the terranean surface 102 shortly into the Earth. A portion of the wellbore portion 112 enclosed by the conductor casing 104 may be a large diameter borehole.

Downhole of the conductor casing 104 may be the surface casing 106. The surface casing 106 may enclose a slightly smaller borehole and protect the wellbore 112 from intrusion of, for example, freshwater aquifers located near the terranean surface 102. The wellbore 112 may then extend vertically downward. This portion of the wellbore 112 may be enclosed by the intermediate casing 108. In some aspects, the location in the wellbore 112 at which the formation fluid sampling tool 116 is moved to may be an open hole portion (for example, with no casing present) of the wellbore 112.

As shown in the implementation of FIG. 1, the formation fluid sampling tool 116 includes a tubular housing 118 and a sampling probe 120. As depicted in FIG. 1, the housing 118 of the formation fluid sampling tool 116 can be coupled (for example, threadingly or through another connection) to the downhole conveyance 110.

In some aspects, the sampling probe 120 may generally sample formation fluids 150 from a nearby subterranean formation 114. In some implementations, the formation fluids 150 contained within the subterranean formation 114 can include heavy oil, extra heavy oil, bitumen, or a combination thereof. Heavy oils typically have a viscosity in a range of 100 centipoise to 10,000 centipoise. Some subterranean formations 114, such as tar mats, contain extra heavy oil or bitumen, which typically have a viscosity greater than 10,000 centipoise. In some aspects, the sampling probe 120 is configured to sample heavy oil, extra heavy oil, or bitumen contained within a subterranean formation 114.

In some implementations, the sampling probe 120 includes an opening that is configured to receive formation fluids 150 from the subterranean formation 114. In some implementations, as depicted in FIG. 1, the sampling probe 120 is located proximate the external surface of the housing. In some examples, the sampling probe 120 is disposed on the external surface of the housing 118.

In some aspects, as described in more detail herein, the sampling probe 120 includes two or more heating elements configured to heat the external surface of the probe 120. The heated external surface of the probe 120 can be used to heat formation fluids in the vicinity of the probe 120. For example, the two or more heating elements may be configured to heat the external surface of the sampling probe 120, and the heated surface of the sampling probe 120 may conductively transfer heat to the subterranean formation 114 to heat one or more formation fluids 150 contained within the formation 114, which results in reduced viscosity and increased mobility of the formation fluids 150. In some implementations, the two or more heating elements of the sampling probe 120 are arranged concentrically around an opening of the sampling probe 120.

In some implementations, the sampling probe 120 may be configured to physically contact a surface of the subterranean formation 114. For example, as depicted in FIG. 1, an external surface of the sampling probe 120 may be placed against the surface of the wellbore 112 adjacent the subterranean formation 114, such that the heated surface of the sampling probe 120 conductively transfers heat to the subterranean formation 114, which reduces the viscosity and increases the mobility of fluids in the formation 114. In some implementations, a piston of the formation fluid sampling tool 116 may be used to extend the sampling probe 120 outwardly from the housing 118 of the formation fluid sampling tool 116 until an external surface of the sampling probe 120 contacts a surface of the subterranean formation 114. As described in further detail herein, the sampling probe 120 may also include one or more sealing elements. In some aspects, one or more sealing elements may be provided on the external surface of the sampling probe 120 to fluidly seal the connection between the surface of the sampling probe 120 and the formation 114 to prevent formation fluids 150 from leaking into the wellbore 112 and improve sampling of formation fluids 150 through the opening of the sample probe 120.

In some implementations, the formation fluid sampling tool 116 includes two or more sampling probes 120. For example, as described in further detail herein, the formation fluid sampling tool 116 can include two or more sampling probes 120 arranged radially on the surface of the housing 118 of the formation fluid sampling tool 116.

Figure 2A:
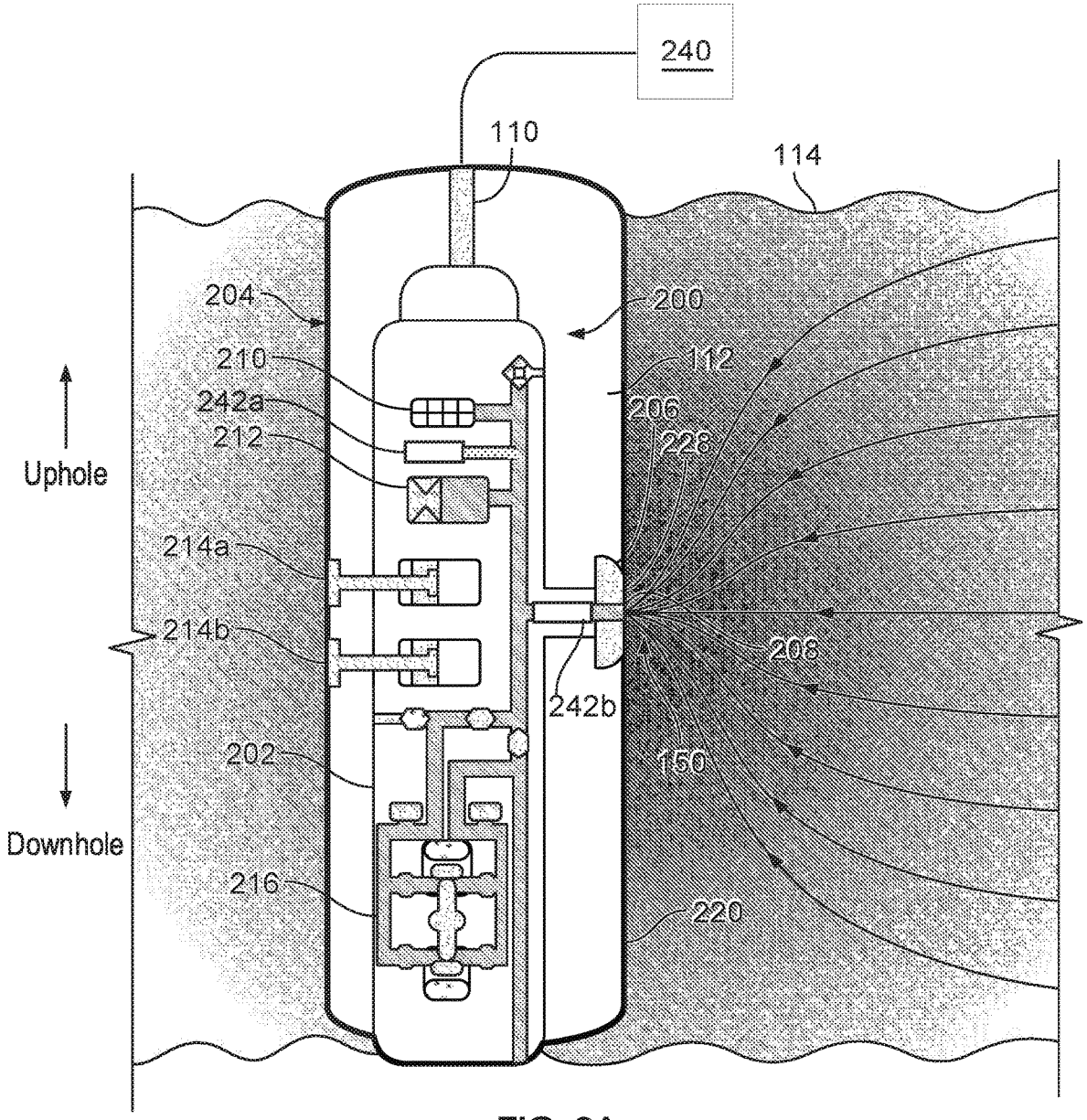
FIG. 2A is a schematic illustration of an example implementation of a formation fluid sampling tool for a formation fluid sampling system according to the present disclosure.
Figure 2B:
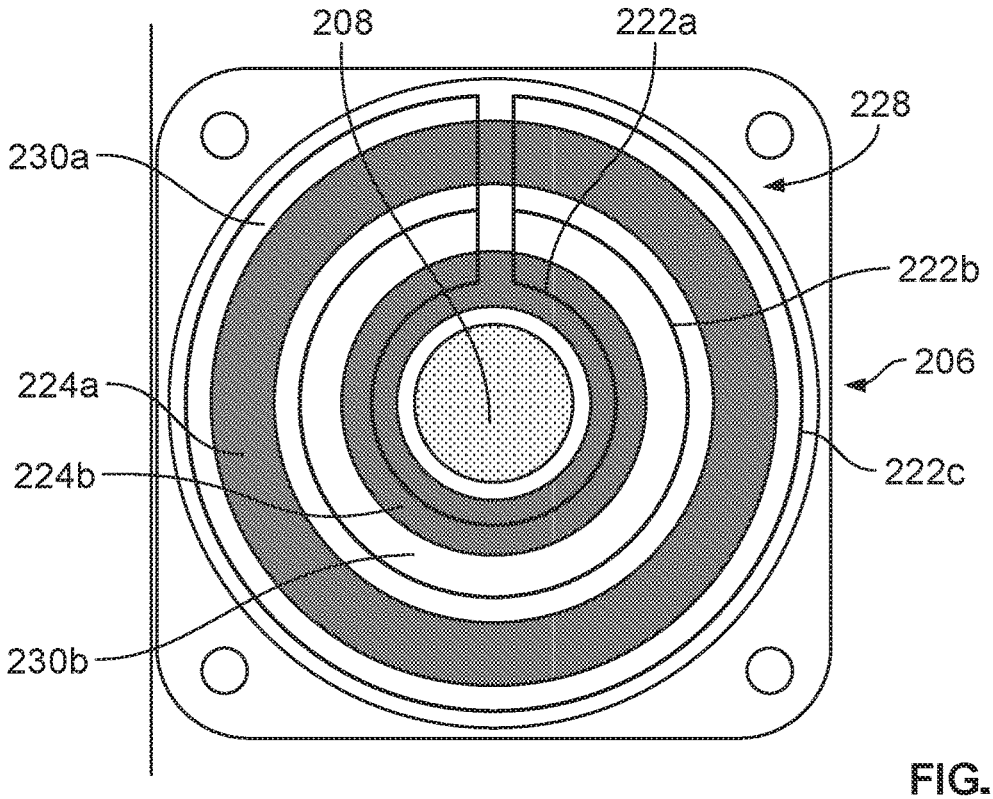
FIG. 2B is a schematic illustration of an example sampling probe of the example formation fluid sampling tool according to the present disclosure.
Figure 2C:
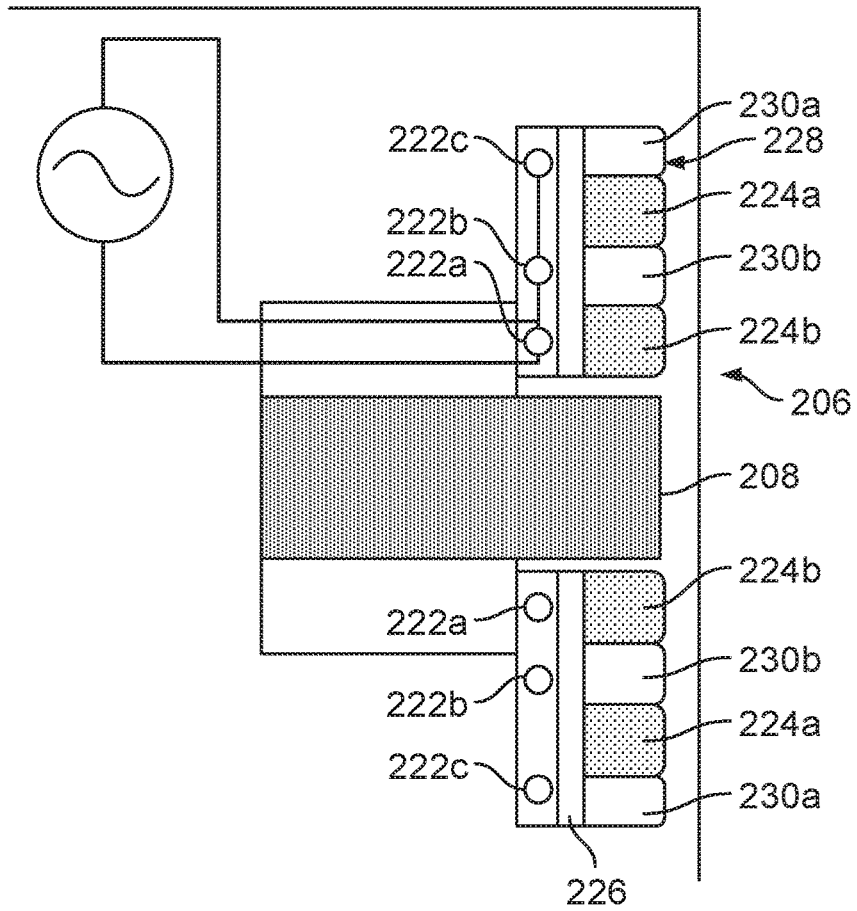
FIG. 2C is a schematic cross-sectional view of the example sampling probe of the example formation fluid sampling tool according to the present disclosure.

As illustrated in FIG. 1, the formation fluid sampling tool 116 is communicably coupled through a control line 111 to a control system 124, which, in this example, is located at the terranean surface 102. The control system 124 may be a microprocessor-based, mechanical, or electromechanical controller, as some examples. The control system 124, in some aspects, may send and receive data between it and the formation fluid sampling tool 116, as well as, for example, provide electrical power to the formation fluid sampling tool 116. The control system 124 may perform one or more operations described in the present disclosure to operate all or parts of the formation fluid sampling tool 116. FIGS. 2A-2C are schematic illustrations of an example implementation of the formation fluid sampling tool 200 for sampling one or more formation fluids 150 from a subterranean formation 114. For example, in some aspects, the formation fluid sampling tool 200 may be used in the wellbore system 100 as formation fluid sampling tool 116. In some implementations, the formation fluid sampling tool 200 is configured to sample heavy oil and extra heavy oil contained within a subterranean formation 114.

FIG. 2A is a schematic illustration of the formation fluid sampling tool 200 positioned in the wellbore 112 and coupled to the downhole conveyance 110. FIG. 2B is a schematic illustration of an external surface 228 of a sampling probe 206 of the formation fluid sampling tool 200. FIG. 2C is a schematic cross-sectional view of the sampling probe 206 of the formation fluid sampling tool 200.

The illustrated implementation of the formation fluid sampling tool 200 includes a housing 202 that couples to the downhole conveyance 110. In some implementations, the housing 202 is a tubular-shaped housing. As depicted in FIG. 2A, the housing 202 of the formation fluid sampling tool 200 is configured to be disposed within a wellbore 112 proximate a subterranean formation 114.

As illustrated in FIG. 2A, the formation fluid sampling tool 200 also includes a sampling probe 206 proximate the external surface 204 of the housing 202. In some implementations, the sampling probe 206 is disposed on the external surface 204 of the housing 202. The sampling probe 206 is configured to conductively heat a subterranean formation 114. As described in further detail, the sampling probe 206 includes an central opening 208 configured to receive one or more heated formation fluids 150, and two or more heating elements arranged concentrically around the central opening 208. In some implementations, the sampling probe 206 is configured to contact the inner wall 220 of the wellbore 112 adjacent the subterranean formation 114, as depicted in FIG. 2A. In some examples, the sampling probe 206 is configured to penetrate through the mud cake of the wellbore 112 and directly contact the subterranean formation 114.

In some implementations, the formation fluid sampling tool 200 includes a pressure sensor 210. As depicted in FIG. 2A, the pressure sensor 210 may be contained within the housing 202 of the formation fluid sampling tool 200. In some implementations, the pressure sensor 210 is used to monitor the pressure of the wellbore 112 and the subterranean formation 114. In some examples, the pressure sensor 210 can detect changes in pressure of the subterranean formation 114 during fluid sampling. In some implementations, the pressure sensor 210 can send data regarding the pressure of the wellbore 112 or the subterranean formation 114 (or both) to a control system (for example control system 124 of FIG. 1) for further analysis.

For example, pressure system 210 can send data related to the pressure of the subterranean formation 114 to a control system during the process of sampling one or more fluids 150 from the formation 114, and, based on this data, the control system can determine the changes in pressure of the formation 114 in real time as a function of a pumping time. In some implementations, the pressure sensor 210 determines a pressure of the subterranean formation 114 prior to any sampling of the formation 114.

In some implementations, the formation fluid sampling tool 200 includes a sample chamber 212. As depicted in FIG. 2A, the sample chamber 212 is contained within the housing 202 of the formation fluid sampling tool 200 and is fluidly coupled to the central opening 208 of the sampling probe 206. In some aspects, the sample chamber 212 collects samples of one or more formation fluids 150 sampled from the subterranean formation 114 by the sampling probe 206.

For example, a portion of the formation fluids 150 collected through the central opening 208 of the sampling probe 206 are circulated into the sample chamber 212. In some implementations, samples of formation fluid collected by the sample chamber 212 can be analyzed to determine one or more properties of the formation fluids 150 contained within the subterranean formation 114.

In some implementations, the formation fluid sampling tool 200 includes one or more pistons 214*a*, 214*b*. In some aspects, the one or more pistons 214*a*, 214*b* can be used to position the formation fluid sampling tool 200 within the wellbore 112. For example, at least one of the pistons 214*a*, 214*b* can be used to position the formation fluid sampling tool 200 so that the external surface 228 of the sampling probe 206 contacts an inner wall 220 of the wellbore 112 adjacent the subterranean formation 114. For example, the pistons 214*a*, 214*b* may extend outward from the external surface 228 of the sampling probe 206 to the inner wall 220 of the wellbore 112, and the extension of the pistons 214*a*, 214*b* pushes the sampling tool 200 towards the inner wall 220 of the wellbore 112 until the sampling probe 206 contacts the inner wall 220 of the wellbore 112. In some implementations, the pistons 214*a*, 214*b* are coupled to a portion of the housing 202 of the sampling tool 200 opposite the sampling probe 206.

In some implementations, the formation fluid sampling tool 200 includes a downhole fluid identification system 216. As depicted in FIG. 2A, the fluid identification system 216 may be fluidly coupled to the central opening 208 of the sampling probe 206 in order to receive formation fluid 150 captured by the sampling probe 206. In some aspects, the fluid identification system 216 monitors mud filtrate contamination of the formation fluid collected by the formation fluid sampling tool 200.

In some implementations, the fluid identification system 216 performs analysis of the captured formation fluids 150 to determine the composition and properties of the formation fluids 150. For example, the fluid identification system 216 can perform downhole fluid analysis on the captured formation fluids 150 to identify the type of formation fluid being collected by the formation fluid sampling tool 200 (for example, gas, oil, or water). In some implementations, the fluid identification system 216 calculates and predicts the one or more thermal properties of the formation fluids and the reservoir based on data related to the composition and properties of the captured formation fluid 150. For example, based on the composition and properties of the captured formation fluid 150, the fluid identification system 216 can perform downhole analysis to calculate or predict a variety of properties of the reservoir rocks and formation fluids, such as density, viscosity, salinity, oxygen isotopes, bubble point pressure, solution gas, acid and base number, asphaltene content, interfacial tension, and other properties.

In some implementations, the fluid identification system 216 is communicably coupled to a control system (for example, control system 124 of FIG. 1). In some examples, data related to the composition and properties of the captured formation fluid 150 can be transmitted from the fluid identification system 216 of the formation fluid sampling tool 200 to a control system located outside of the wellbore 112 for further analysis.

As illustrated in FIG. 2B, in some implementations, the sampling probe 206 of the formation fluid sampling tool 200 includes a plurality of heating elements 222*a*, 222*b*, 222*c*. While FIGS. 2A-2C depict the sampling probe 206 as having three heating elements 222*a*, 222*b*, 222*c*, any number of heating elements may be provided. In some implementations, the heating elements 222*a*, 222*b*, 222*c* are arranged concentrically around the central opening 208 of the sampling probe 206. In some examples, the heating elements 222*a*, 222*b*, 222*c* are disposed on conductive portions 230*a*, 230*b* of the external surface 228 of the sampling probe 206. In some implementations, the conductive portions 230*a*, 230*b* of the external surface 228 of the sampling probe 206 are composed of a thermally conductive material, such as metal. In some implementations, the heating elements 222*a*, 222*b*, 222*c* are configured to directly contact an inner wall 220 of the wellbore 112 proximate the subterranean formation 114. In some examples, the sampling tool 200 is configured to penetrate a mud cake of the wellbore 112 and the heating elements 222*a*, 222*b*, 222*c* are configured to directly contact the subterranean formation 114. As depicted in FIG. 2B, the heating elements may be circular shaped.

In some implementations, as shown in FIG. 2C, a conductive layer 226 is disposed between the external surface 228 of the sampling probe 206 and the heating elements 222*a*, 222*b*, 222*c*. Heat generated by the heating elements 222*a*, 222*b*, 222*c* may be transferred to conductive portions 230*a*, 230*b* of the external surface 228 of the sampling probe 206 through the conductive layer 226. The conductive layer 226 is composed of a thermally conductive material, such as metal.

In some implementations, each of the heating elements 222*a*, 222*b*, 222*c* is configured to be heated to a set temperature. In some implementations, each of the heating elements 222*a*, 222*b*, 222*c* is configured to be heated to a different temperature. In some examples, each of the heating elements 222*a*, 222*b*, 222*c* is configured to be heated to the same temperature. In some implementations, the heating elements 222*a*, 222*b*, 222*c* are electrically coupled to a control system (for example, control system 124 of the FIG. 1) that supplies electricity to the heating elements 222*a*, 222*b*, 222*c*. In some implementations, the electric power required to heat the heating elements 222*a*, 222*b*, 222*c* is less than 100 Watts. In some implementations, the heating elements 222*a*, 222*b*, 222*c* are resistive heating elements. In some examples, the heating elements 222*a*, 222*b*, 222*c* are radio-frequency heating elements.

In some implementations, the sampling probe 206 includes one or more sealing elements 224*a*, 224*b*. As depicted in FIG. 2B, the one or more sealing elements 224*a*, 224*b* may be arranged concentrically around the central opening 208 of the sampling probe 206. In some implementations, the sealing elements 224*a*, 224*b* are disposed on the external surface 228 of the sampling probe 206 between the conductive portions 230*a*, 230*b* of the external surface 228 of the sampling probe 206. For example, the sealing elements 224*a*, 224*b* may be disposed between two of the heating elements 222*a*, 222*b*, 222*c* located on the external surface 228 of the sampling probe. In some aspects, the one or more sealing elements 224*a*, 224*b* seal the external surface 228 of the sampling probe 206 to the wellbore 112 adjacent the subterranean formation 114. The sealing elements 224*a*, 224*b* can prevent formation fluid being sampled by the probe 206 from leaking into the wellbore 112. In some implementations, the one or more sealing elements 224*a*, 224*b* are composed of elastomeric material, such as rubber.

Figure 3A:
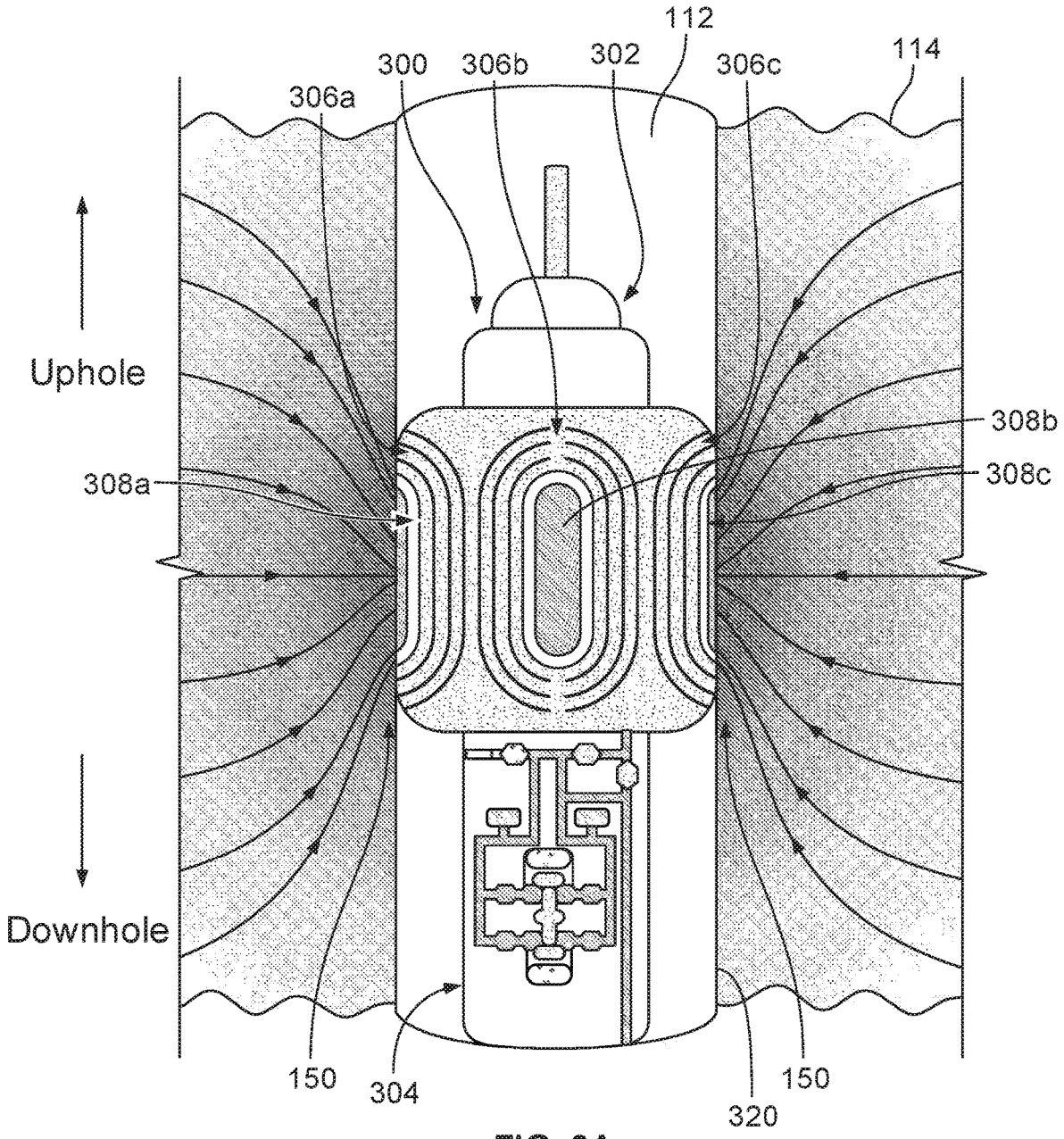
FIG. 3A is a schematic illustration of an example implementation of a formation fluid sampling tool for a formation fluid sampling system according to the present disclosure.
Figure 3B:
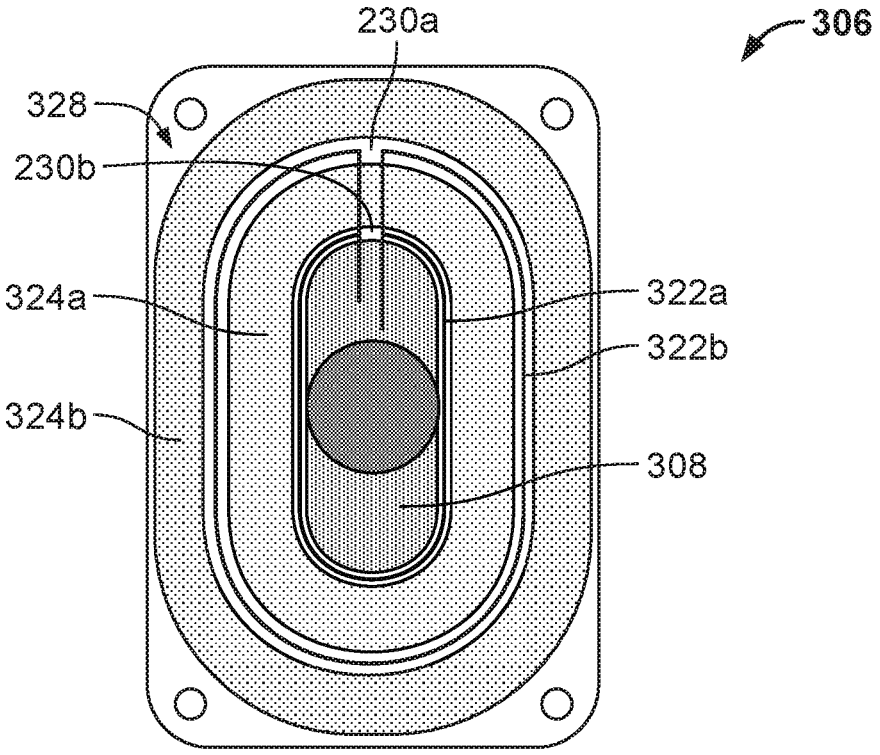
FIG. 3B is a schematic illustration of an example sampling probe of the example formation fluid sampling tool according to the present disclosure.
Figure 3C:
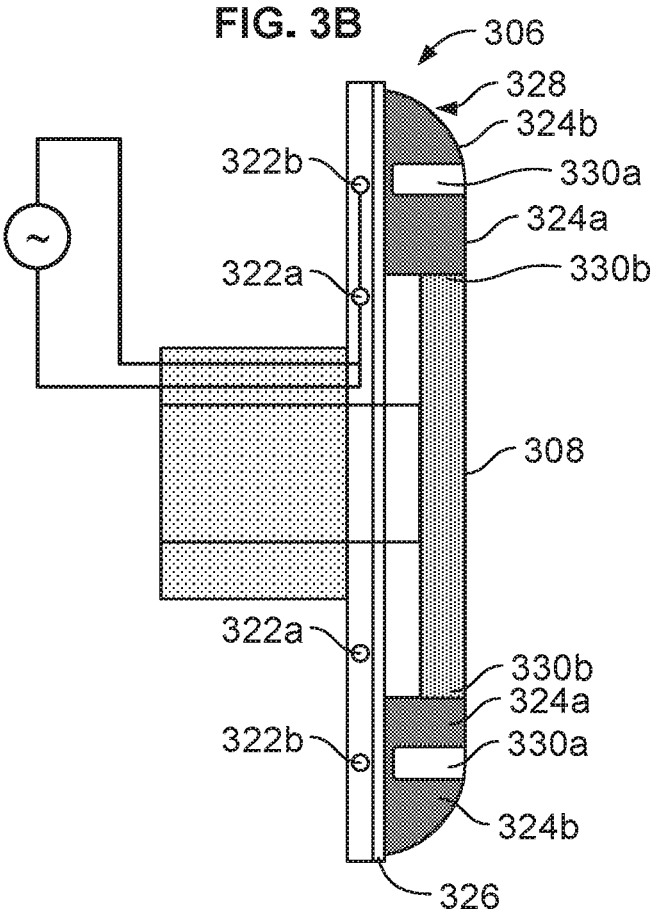
FIG. 3C is a schematic cross-sectional view of the example sampling probe of the example formation fluid sampling tool according to the present disclosure.

FIGS. 3A-3C are schematic illustrations of an example implementation of another formation fluid sampling tool 300 for sampling one or more formation fluids 150 from a subterranean formation 114. In some aspects, the formation fluid sampling tool 300 can be used in the wellbore system 100 as formation fluid sampling tool 116. In some implementations, the formation fluid sampling tool 300 is configured to sample heavy oil, extra heavy oil, bitumen, or a combination thereof contained within a subterranean formation 114.

FIG. 3A is a schematic illustration of the formation fluid sampling tool 300 positioned in the wellbore 112 and coupled to the downhole conveyance 110. FIG. 3B is a schematic illustration of the external surface 328 of a sampling probe 306 of the formation fluid sampling tool 300. FIG. 3C is a schematic cross-sectional view of the sampling probe 306 of the formation fluid sampling tool 300.

As depicted in FIG. 3A, in some implementations, the formation fluid sampling tool 300 includes two or more sampling probes 306*a*, 306*b*, 306*c*. In some examples, the two or more sampling probes 306*a*, 306*b*, 306*c* are arranged on the radial surface 304 of a housing 302 of the formation fluid sampling tool 300.

As depicted in FIG. 3B, the external surface 328 of each of the sampling probes 306*a*, 306*b*, 306*c* may be oval-shaped, and each of the sampling probes 306*a*, 306*b*, 306*c* may include one or more oval-shaped heating elements 322*a*, 322*b* arranged concentrically around an oval-shaped central opening 308. While FIGS. 3B-3C depict the sampling probe 306 as having two heating elements 322*a*, 322*b*, any number of heating elements may be provided. The oval shape of the sampling probe 306, including the oval shape of the central opening 308 and the heating elements 322*a*, 322*b*, provides for an increased surface area compared to circular-shaped sampling probes (for example, sampling probe 206 of FIGS. 2A-2C). This increased surface area associated an increased area in the formation 114 that is heated by the heating elements 322*a*, 322*b*, as well as a larger opening to receive a greater flow of formation fluids 150.

Similar to sampling probe 206 of FIGS. 2A-2C, the heating elements 322*a*, 322*b* of sampling probe 306 are disposed on conductive portions 330*a*, 330*b* of the external surface 328 of the sampling probe 306. In some implementations, conductive portions 330*a*, 330*b* of the external surface 328 of the sampling probe 306 are composed of a thermally conductive material, such as metal. In some examples, the heating elements 322*a*, 322*b* may be configured to directly contact an inner surface of the wellbore 112 proximate the subterranean formation 114. In some examples, the sampling tool 300 is configured to penetrate a mud cake of the wellbore 112 and the heating elements 322*a*, 322*b* are configured to directly contact the subterranean formation 114.

In some implementations, as shown in FIG. 3C, a conductive layer 326 is disposed between the external surface 328 of the sampling probe 306 and the heating elements 322*a*, 322*b*. For example, heat generated by the heating elements 322*a*, 322*b* may be transferred to conductive portions 330*a*, 330*b* of the external surface 328 of the sampling probe 306 through the conductive layer 326. The conductive layer 326 is composed of a thermally conductive material, such as metal.

In some implementations, each of the heating elements 322*a*, 322*b* is configured to be heated to a set temperature. In some implementations, each of the heating elements 322*a*, 322*b* is configured to be heated to a different temperature. In some examples, each of the heating elements 322*a*, 322*b* is configured to be heated to the same temperature. In some implementations, the heating elements 322*a*, 322*b* are electrically coupled to a control system (for example, control system 124 of the FIG. 1) that supplies electricity to the heating elements 322*a*, 322*b*. In some implementations, the electric power required to heat the heating elements 322*a*, 322*b* is greater than 100 Watts. In some implementations, the heating elements 322*a*, 322*b* are resistive heating elements. In some examples, the heating elements 322*a*, 322*b* are radio-frequency heating elements.

In some implementations, the sampling probe 306 includes one or more oval-shaped sealing elements 324*a*, 324*b*. As depicted in FIG. 3B, the one or more sealing elements 324*a*, 324*b* may be concentrically arranged around the central opening 308 of the sampling probe 306. In some implementations, the sealing elements 324*a*, 324*b* are disposed on the external surface 328 of the sampling probe 306 between conductive portions 330*a*, 330*b* of the external surface 328. For example, the sealing elements 324*a*, 324*b* may be disposed between two of the heating elements 322*a*, 322*b* located on the external surface 328 of the sampling probe 306. In some aspects, the one or more sealing elements 324*a*, 324*b* act to seal the external surface 328 of the sampling probe 306 to the subterranean formation 114. The sealing elements 324*a*, 324*b* can help prevent formation fluid being sampled by the probe 206 from leaking into the wellbore 112. In some implementations, the one or more sealing elements 324*a*, 324*b* are composed of elastomeric material, such as rubber.

An example operation of the formation fluid sampling tool 200 is described with reference to FIGS. 2A-2C. For example, with reference to FIG. 2A, the formation fluid sampling tool 200 is positioned in a wellbore 112 and in conductive heat transfer contact with a subterranean formation 114. In some implementations, positioning the formation fluid sampling tool 200 in the wellbore 112 includes positioning the formation fluid sampling tool 200 to a target depth. For example, the formation fluid sampling tool 200 may be positioned in the wellbore 112 at a depth identified based on an integrated formation evaluation, such as analysis of conventional openhole logs as well as specialized logs of borehole imaging and nuclear magnetic resonance log.

In some implementations, the formation fluid sampling tool 200 is positioned in the wellbore 112 such that an external surface 228 of the sampling probe 206 of the formation fluid sampling tool 206 contacts an inner wall 220 of the wellbore 112 adjacent the subterranean formation 114. In some examples, the sampling tool 200 is positioned in the wellbore 112 such that the sampling probe 206 penetrates a mud cake of the wellbore 112 to contact the subterranean formation 114. As depicted in FIG. 2B, the heating elements may be circular shaped. In some implementations, the sampling probe 206 is extended outwardly from the housing 202 of the formation fluid sampling tool 200 towards the subterranean formation 114 using one or more electromechanical devices. In some implementations, positioning the formation fluid sampling tool 200 in the wellbore includes positioning the formation fluid sampling tool 200 such that one or more sealing elements 224*a*, 224*b* disposed on the external surface 228 of the sampling probe 206 create a fluid seal between the inner wall 220 of the wellbore 112 and the sampling probe 206, creating a seal between the sampling probe 206 and the formation 114.

After positioning the formation fluid sampling tool 200 in the wellbore 112, an external surface 228 of at least one sampling probe 206 of the formation fluid sampling tool 200 is heated. In some implementations, the external surface 228 of the sampling probe 206 is heated by heating elements 222*a*, 222*b*, 222*c* concentrically arranged around a central opening 208 of the sampling probe 206. In some implementations, as depicted in FIG. 2B, the heating elements 222*a*, 222*b*, 222*c* and the central opening 208 are circular. In some examples, the heating element and central opening are oval-shaped (for example, heating element 322*a*, 322*b* and central opening 308 of FIGS. 3A-3C).

In some implementations, the heating elements 222*a*, 222*b*, 222*c* are disposed on conductive portions 230*a*, 230*b* of the external surface 228 to heat the conductive portions 230*a*, 230*b* of the external surface 228 of the sampling probe 206. In some examples, a conductive layer 226 is disposed between the heating elements 222*a*, 222*b*, 222*c* and the external surface 228 of the sampling probe 206, and the conductive layer 226 transfers heat generated by the heating elements 222*a*, 222*b*, 222*c* to the external surface 228 of the sampling probe 206. In some implementations, each of the heating elements 222*a*, 222*b*, 222*c* are heated to a set temperature. In some implementations, each of the heating elements 222*a*, 222*b*, 222*c* are heated to a different temperature. In some examples, each of the heating elements 222*a*, 222*b*, 222*c* are heated to the same temperature. In some implementations, the heating elements 222*a*, 222*b*, 222*c* are electrically coupled to a control system (for example, control system 124 of the FIG. 1) that supplies electricity to the heating elements 222*a*, 222*b*, 222*c*. In some implementations, the heating elements 222*a*, 222*b*, 222*c* are resistive heating elements. In some examples, the heating elements 222*a*, 222*b*, 222*c* are radio-frequency heating elements.

The heat generated by the heating elements 222*a*, 222*b*, 222*c* is conductively transferred from the heated external surface 228 of the sampling probe 206 to one or more formation fluids 150 entrained in the subterranean formation 114. For example, the heating elements 222*a*, 222*b*, 222*c* may be disposed on external surface 228 of the sampling probe 206 and in physical contact with the subterranean formation 114, and the contact of the heated external surface 228 of the sampling probe 206 with the inner wall 220 of the wellbore 112 results in conductive transfer of heat from the external surface 228 of the sampling probe 206 to the subterranean formation 114. In some implementations, the heating elements 222*a*, 222*b*, 222*c* are disposed behind a conductive layer 226, and heat generated by the heating elements 222*a*, 222*b*, 222*c* is transferred through the conductive layer 226 to one or more conductive portions 230*a*, 230*b*, which are in contact with the inner wall 220 of the wellbore 112 and conductively transfer heat to the subterranean formation 114.

In some implementations, the heat conductively transferred from the heated external surface 228 of the sampling probe 206 to the formation 114 distributes within the formation 114 in a spherical path, with higher temperatures occurring in the portion of the formation 114 closest to the sampling probe 206, as depicted in FIG. 2A. In some implementations, the electric power required to heat the formation fluids 150 near the sampling probe 206 is less than 100 Watts.

One or more heated formation fluids 150 may be received through the central opening 208 of the at least one sampling probe 206. For example, conductively transferring heat from the heated surface 208 of the sampling probe 206 to the subterranean formation 114 heats the fluids contained within the subterranean formation 114, which reduces the viscosity and increases the mobility of the formation fluids 150. In some implementations, the heated formation fluids 150 have a viscosity low enough to flow through the central opening 208 of the sampling probe 206. Decreasing the viscosity of the formation fluids 150 by heating the formation fluids 150 near the sampling point using the heated surface 228 of the sampling probe 206 results in an increased mobility and, thus, increased flow rate, of the formation fluids 150 into the sampling probe 206. In some implementations, the one or more heated formation fluids 150 include heavy oil, extra heavy oil, bitumen, or a combination thereof.

In some implementations, a pump 240 is used to produce a pressure differential between the subterranean formation 114 and the wellbore 112 in order to encourage the flow of formation fluids 150 into the formation fluid sampling tool 200. For example, the pump 240 creates a pressure differential that drives fluid 150 from the subterranean formation 114 into the sampling tool 200. Although illustrated in FIG. 2A as external to the external surface 204 and the housing 202, in some aspects, the pump 240 may be internal to one or both of the external surface 204 and the housing 202.

In some implementations, the pressure of the wellbore 112 and the pressure of the subterranean formation 114 are determined using one or more pressure sensors 210. In some implementations, the pressure differential between the subterranean formation 114 and the wellbore 112 is monitored by the one or more pressure sensors 210 of the formation fluid sampling tool 200, and pumping is performed to maintain a pressure differential between the subterranean formation 114 and the wellbore 112.

In some implementations, pumping begins prior to heating the external surface 228 of the sampling probe 206. In some examples, pumping is conducted while the heating elements 222*a*, 222*b*, 222*c* heat the external surface 228 of the sampling probe 206. In some implementations, pumping is conducted once the external surface 228 of the sampling probe 206 is heated to a predetermined temperature.

In some implementations, the one or more heated formation fluids 150 are circulated through the formation fluid sampling tool 200. For example, after the heated formation fluids 150 are received through the central opening 208 of the sampling probe 206, the heated formation fluids 150 may be circulated to different regions of the formation fluid sampling tool 200. For example, a portion of the formation fluids 150 may be provided to a sample chamber 212 for collecting a sample of the formation fluids 150. In some implementations, the formation fluids 150 are circulated to a fluid identification system 216 for identification and analysis of the formation fluids 150. For example, the composition and degree of mud filtrate contamination of the sampled formation fluids 150 may be determined by providing the formation fluids 150 to the fluid identification system 216. In some examples, formation fluids 150 determined by fluid identification system 216 as being contaminated with mud filtrate are dumped into the borehole. In some examples, formation fluids 150 determined by fluid identification system 216 as not being contaminated with mud filtrate fluids are sampled using sample chamber 212. In some implementations, data generated by the fluid identification system 216 regarding the identity and composition of the formation fluids 150 may be provided to a control system (for example, control system 124 of FIG. 1) for further analysis. In some implementations, the one or more heated formation fluids 150 are circulated through the formation fluid sampling tool 200 using a pump of the formation fluid sampling tool 200.

In some implementations, one or more conditions of the wellbore 112 or the formation 114 are monitored by one or more sensors of the formation fluid sampling tool 200. For example, the temperature of the housing 202 of the formation fluid sampling tool 200 and the one or more heating elements 222*a*, 222*b*, 222*c* may be monitored by a temperature sensor of the formation fluid sampling tool 200. In some examples, the temperature of formation fluids 150 received through the sampling probe 206 can be monitored by a temperature sensor of the formation fluid sampling tool 200. In some implementations, the fluid pressure of the fluid in the subterranean formation 114 can be measured with a pressure sensor 210 of the formation fluid sampling tool 200. For example, changes in the fluid pressure and flow rate of the formation fluids 150 can be monitored by one or more sensors of the formation fluid sampling tool 200 in relation to the changes in temperature of the formation fluids 150 in order to determine the thermal properties of the formation fluids 150 and the reservoir rock of the subterranean formation 114.

In some implementations, the temperature provided by the heating elements 222*a*, 222*b*, 222*c* is adjusted based on the wellbore conditions monitored by the one or more sensors of the formation fluid sampling tool 200. For example, if the temperature of the housing 202 or the temperature of the sampling probe 206 is identified by one or more temperature sensor 242*a*, 242*b* as exceeding a threshold temperature, the heat supplied by the heating elements 222*a*, 222*b*, 222*c* may be reduced. In some examples, a first temperature sensor 242*a* is provided to monitor the temperature of the housing 202 of the sampling tool 200 and a second temperature sensor 242*b* is provided to monitor the temperature of the sampling probe 206 of the sampling tool 200. In some implementations, other actions may be conducted in response to one or more conditions monitored by the one or more sensors of the formation fluid sampling tool 200. For example, if the temperature of the housing 202 is identified by a temperature sensor as exceeding a threshold temperature, the tool 200 can circulate mud from the formation throughout the formation fluid sampling tool 200 to cool down the housing 202 of the tool 200.

In some implementations, the sensors are communicably coupled to a control system, such as control system 124 of FIG. 1, and data related to the conditions of the wellbore being monitored by the one or more sensors of the formation fluid sampling tool 200 are provided to the control system for further analysis. In some implementations, the conditions of the wellbore are determined by one or more sensors of the formation fluid sampling tool 200 prior to conducting formation fluid sampling, and monitoring of the conditions continues throughout the process of sampling the formation fluids 150.

EXAMPLES

Tests were conducted to determine the effects of conductively transferring heat from the surface of a sampling probe to a subterranean formation. Based on the testing, it was determined that heating a subterranean formation with a heated sampling probe (such as probes 206 or 306 of FIGS. 2B and 3B, respectively) resulted in decreased oil viscosity of the formation fluid, and, as a result, the flow rate ($Q_T$) of the formation fluid into the heated sampling probe was increased. Based on these tests, the relationship between the flow rate of the formation fluid and the heat transferred by the sampling probe was determined to depend on (1) the maximum temperature generated by the heating elements of the sampling probe and (2) the ratio of the equivalent radius of the heating element of the sampling probe to the equivalent radius of the central opening of the sampling probe ($r_e/r_p$). The ratio of sampling flow rate with heating ($Q_T$) over the sampling flow rate without heating (Q), is demonstrated in Eq. 1:

$$q_r = \frac{Q_T}{Q} = \frac{\left(\frac{T_e}{T_f}\right)^b}{1 - \frac{r_p}{r_e}\left(1 - \left(\frac{T_e}{T_f}\right)^{b-1} \frac{(1-(T_f/T_e)^{b-1})}{(1-T_f/T_e)(b-1)}\right)} \tag{1}$$

wherein $T_e$ is the maximum temperature the heating element of the sampling probe is capable of generating, $T_f$ is the initial temperature of the subterranean formation, $r_e$ is the equivalent radius of the heating element, $r_p$ is the equivalent radius of the central opening of the sampling probe, and b is the rate of viscosity reduction of the sampled fluid as a function of temperature.

The maximum temperature that the probe heating element is capable of generating ($T_e$) was limited by materials available to produce heating elements and the power that could be supplied to the heating elements. The maximum temperature that can be provided to the formation by the probe heating to increase flow rate of formation fluids is also limited by the properties of the formation fluids, as the properties of the formation fluids may be negatively impacted by excessive heating, such as through cracking resulting from excess heating. As a result, it was determined that the primary parameter in the design of the heated formation fluid sampling tool to influence flow rate was the ratio of the radius of the heating elements of the sampling probe to the radius of the probe opening ($r_e/r_p$). In addition, it was determined that increasing the probe opening radius ($r_p$) of the sampling probes and utilizing other probe geometries, such as the oval-shaped probes depicted in FIGS. 3A-3C, also improves flow rates of formation fluid sampling.

Figure 4:
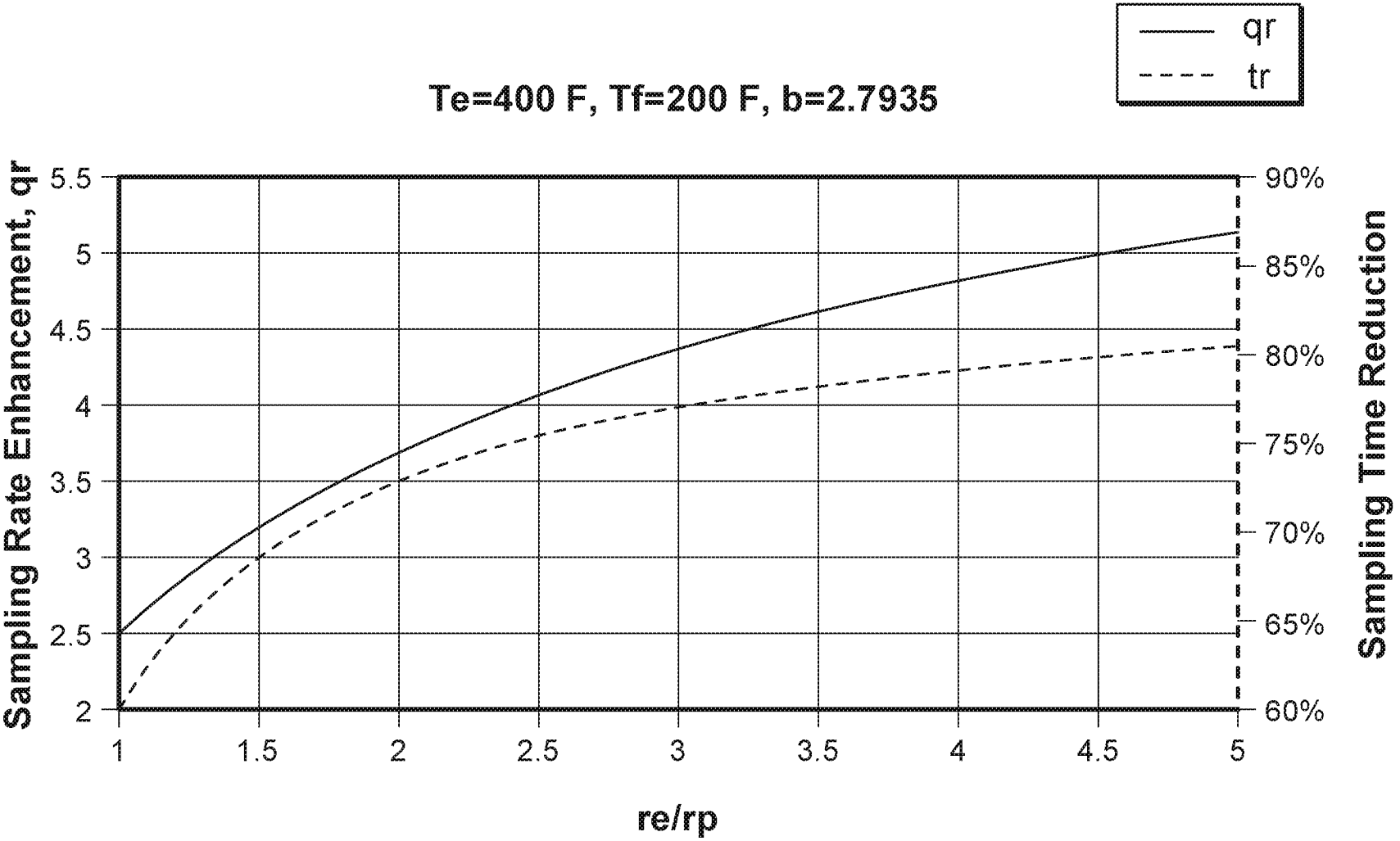
FIG. 4 shows the relationship between the ratio of a radius of a heating element to a radius of a sampling probe opening and sampling rate enhancement.

FIG. 4 shows an example of the relationship between the ratio of the radius of the heating elements to the radius of the probe opening ($r_e/r_p$) and sampling rate enhancement. As depicted in FIG. 4, the ratio of the radius of the heating elements to the radius of the probe opening ($r_e/r_p$) was varied from with 1 to 5. The maximum temperature that the sampling probe heating element was capable of generating ($T_e$) was 400° F., the initial reservoir temperature ($T_f$) was 200° F., and the formation fluid had a b factor of 2.7935. As shown in FIG. 4, as the radius of the heating element was increased relative to the radius of the central opening of the probe (increasing $r_e/r_p$), the sampling rate enhancement ($q_r$) also increased.

In addition, the effect of the ratio of the radius of the heating elements to the radius of the probe opening ($r_e/r_p$) on the sampling time reduction ($t_r$) was determined. The relationship between sampling rate enhancement ($q_r$) and sampling time reduction ($t_r$) is provided by Equation 2:

$$t_r = \frac{Q_T - Q}{Q_T} = 1 - \frac{1}{q_r} \tag{2}$$

As determined by Equation 2, and as depicted in FIG. 4, for a sampling tool having a ratio of the radius of the heating elements to the radius of the probe opening ($r_e/r_p$) of 5, the sampling time is reduced by 80% compared to a sampling tool with no heating elements.

Figure 5:
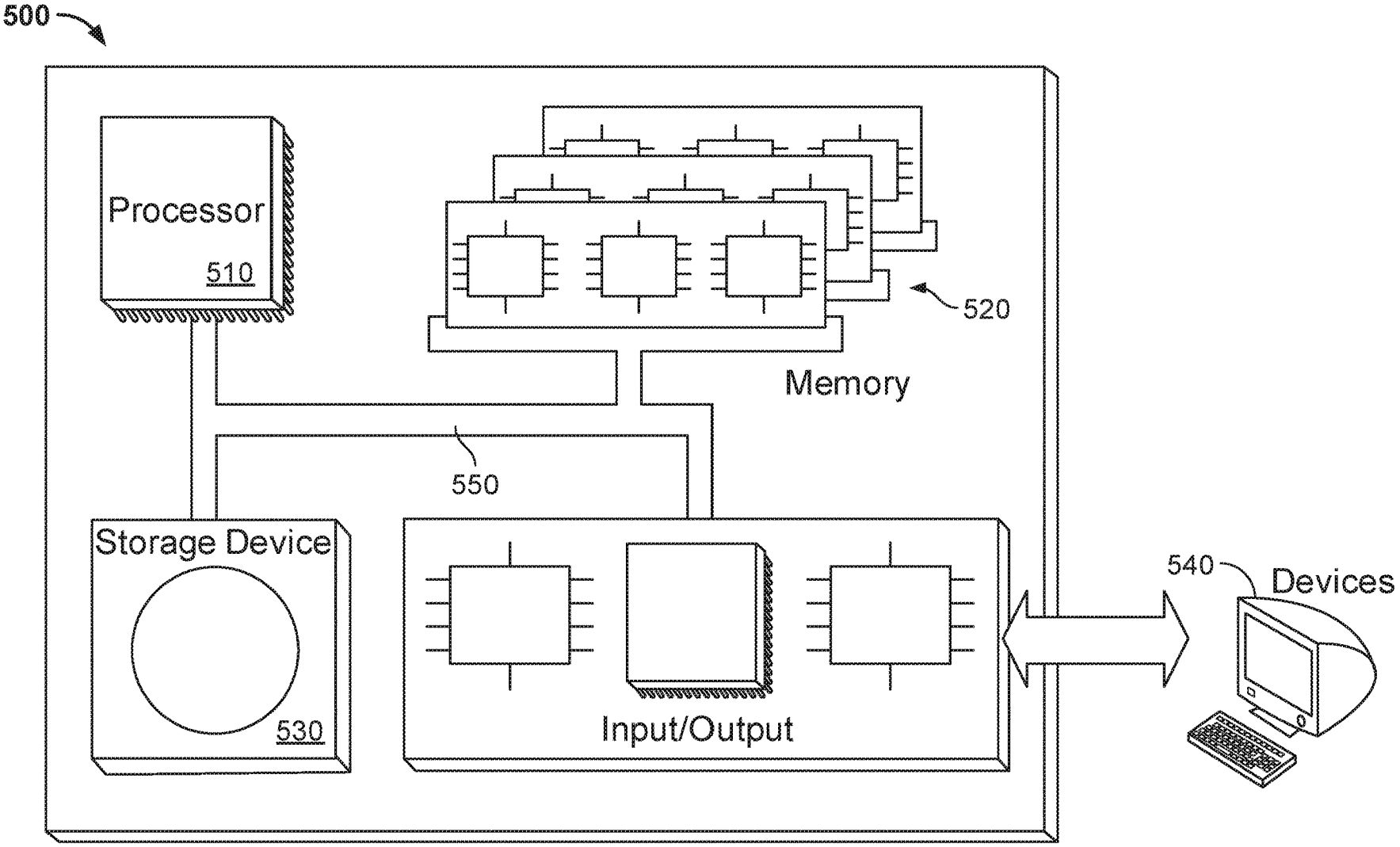
FIG. 5 is a schematic illustration of an example control system for a formation fluid sampling tool according to the present disclosure.

FIG. 5 is a schematic illustration of an example controller 500 (or control system 500) for a downhole formation fluid sampling tool. For example, the controller 500 can be used for the operations described previously, for example as or as part of the control system 124, or other controllers described herein. For example, the controller 500 may be communicably coupled with, or as a part of, a formation fluid sampling tool (such as formation fluid sampling tool 116) as described herein.

The controller 500 is intended to include various forms of digital computers, such as printed circuit boards (PCB), processors, digital circuitry, or other hardware. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, or a tape device.

The input/output device 540 provides input/output operations for the controller 500. In one implementation, the input/output device 540 includes a keyboard, a pointing device, or both. In another implementation, the input/output device 540 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A formation fluid sampling tool comprising: a housing; and at least one sampling probe proximate an external surface of the housing, the at least one sampling probe comprising: an opening sized and positioned to receive one or more heated formation fluilds; a plurality of heating elements arranged concentrically around the opening and configured to conductively heat a subterranean formation through an external surface of the sampling probe, wherein the at least one sampling probe further comprises at least one sealing element disposed on the external surface of the at least one sampling probe, and wherein the at least one sealing element is disposed between two heating elements of the plurality of heating elements, wherein the at least one sampling probe further comprises a conductive layer disposed between the plurality of heating elements and the external surface of the at least one sampling probe, the conductive layer configured to transfer heat from the plurality of heating elements of the external surface of the at least one sampling probe.

2. The formation fluid sampling tool of claim 1, wherein the external surface of the sampling probe is configured to contact a wellbore proximate the subterranean formation.

3. The formation fluid sampling tool of claim 1, wherein the plurality of heating elements is disposed on the external surface of the at least one sampling probe.

4. The formation fluid sampling tool of claim 1, wherein the plurality of heating elements is arranged as concentric circles or concentric ovals around the opening.

5. The formation fluid sampling tool of claim 4, wherein the distance between adjacent heating elements of the plurality of heating elements is equal.

6. The formation fluid sampling tool of claim 1, wherein each of the plurality of heating elements is configured to be heated to a different temperature.

7. The formation fluid sampling tool of claim 1, wherein the at least one sampling probe comprises two or more sampling probes arranged radially on the external surface of the housing.

8. The formation fluid sampling tool of claim 1, further comprising at least one pressure sensor configured to measure a pressure of the subterranean formation.

9. A downhole tool comprising: a downhole conveyance; a housing configured to couple with the downhole conveyance; and at least one sampling tool disposed proximate an external surface of the housing, the at least one sampling tool comprising: an opening configured to receive one or more heated formation fluids; and a plurality of heating elements arranged concentrically around the opening and configured to conductively heat a subterranean formation through an external surface of the at least one sampling tool, wherein the at least one sampling tool further comprises at least one sealing element disposed on the external surface of the at least one sampling tool, and wherein the at least one sealing element is disposed between two heating elements of the plurality of heating elements, wherein the at least one sampling probe further comprises a conductive layer disposed between the plurality of heating elements and the external surface of the at least one sampling probe, the conductive layer configured to transfer heat from the plurality of heating elements to the external surface of the at least one sampling probe.

10. The downhole tool of claim 9, wherein the external surface of the at least one sampling tool is configured to contact the subterranean formation.

11. The downhole tool of claim 9, wherein the plurality of heating elements is disposed on the external surface of the at least one sampling tool.

12. The downhole tool of claim 9, wherein the downhole conveyance comprises at least one of a wireline, an e-line, or a working string.

13. The downhole tool of claim 9, further comprising at least one pressure sensor configured to measure a pressure of a wellbore and a pressure of the subterranean formation.

14. The downhole tool of claim 9, wherein the at least one sampling tool further comprises at least one sealing element disposed on the external surface of the sampling tool.

15. A formation fluid sampling method comprising: positioning a formation fluid sampling tool in a wellbore and in conductive heat transfer contact with a subterranean formation; heating an external surface of an at least one sampling probe of the formation fluid sampling tool using a plurality of heating elements arranged concentrically around an opening of the at least one sampling probe, wherein the at least one sampling probe further comprises at least one sealing element disposed on the external surface of the of least one sampling probe, and wherein the at least one sealing element is disposed between two heating elements of the plurality of heating elements; wherein the at least one sampling probe further comprises a conductive layer disposed between the plurality of heating elements and the external surface of the at least one sampling probe, conductively transferring heat from the heated external surface of the at least one sampling probe to one or more formation fluids entrained in the subterranean formation; and receiving, through the opening of the at least one sampling probe, the heated one or more formation fluids.

16. The method of claim 15, further comprising circulating the heated one or more formation fluids through at least one of a pressure sensor, a sample chamber, or a fluid identification system.

17. The method of claim 15, wherein positioning the formation fluid sampling tool in the wellbore and in conductive heat transfer contact with the subterranean formation comprises physically contacting the external surface of the at least one sampling probe to an inner wall of the wellbore.

18. The method of claim 15, wherein positioning the formation fluid sampling tool in the wellbore and in conductive heat transfer contact with the subterranean formation comprises extending the at least one sampling probe outward from a housing of the sampling tool towards the subterranean formation.

19. The method of claim 15, further comprising monitoring one or more conditions of the wellbore with at least one sensor of the formation fluid sampling tool.

* * * * *